US005817417A

United States Patent [19]

Fischer et al.

[11] Patent Number: 5,817,417

[45] Date of Patent: Oct. 6, 1998

[54] METHOD FOR CONTINUOUS PRODUCTION OF POLYESTER WEFT YARN FOR TIRE CORD FABRIC AND WEFT YARN MADE BY SAME

[75] Inventors: Klaus Fischer, Lucerne; Paul Schaffner, Kriens, both of Switzerland

[73] Assignee: Rhone-Poulenc Viscosuisse SA, Emmenbrucke, Switzerland

[21] Appl. No.: 718,301

[22] PCT Filed: Jan. 15, 1996

[86] PCT No.: PCT/CH96/00016

§ 371 Date: Sep. 20, 1996

§ 102(e) Date: Sep. 20, 1996

[87] PCT Pub. No.: WO96/23091

PCT Pub. Date: Aug. 1, 1996

[30] Foreign Application Priority Data

Jan. 25, 1996 [CH] Switzerland ..... 196/95

[51] Int. Cl.[6] ..... B32B 27/34

[52] U.S. Cl. ..... 428/395; 428/364; 264/103; 57/3; 57/243; 57/282; 57/310; 57/902

[58] Field of Search ..... 428/364, 395; 264/210.8, 210.7, 103, 211.14, 211.15, 234; 57/243, 236, 237, 902, 282, 310, 3

[56] References Cited

U.S. PATENT DOCUMENTS

| | | | |
|---|---|---|---|
| 4,196,763 | 4/1980 | Imamura | 152/358 |
| 4,296,597 | 10/1981 | Tani et al. | 57/205 |
| 4,334,401 | 6/1982 | Bahia | 57/6 |
| 4,357,385 | 11/1982 | Kuroda et al. | 428/395 |
| 4,416,935 | 11/1983 | Bascom et al. | 442/59 |
| 4,760,690 | 8/1988 | Lang et al. | 57/243 |
| 5,083,419 | 1/1992 | Greifeneder et al. | 57/6 |
| 5,146,738 | 9/1992 | Greifeneder et al. | 57/207 |
| 5,173,231 | 12/1992 | Holland | 264/210.7 |
| 5,174,936 | 12/1992 | Due et al. | 264/103 |

FOREIGN PATENT DOCUMENTS

| | | |
|---|---|---|
| 0223301 | 2/1987 | European Pat. Off. . |

*Primary Examiner*—Patrick Ryan
*Assistant Examiner*—J. M. Gray
*Attorney, Agent, or Firm*—Michael J. Striker

[57] ABSTRACT

The method for continuous production of a multifilament stretchable weft yarn for tire cord fabric includes swirling polyester-POY-filaments with an initial titre of from 170 to 260 dtex by means of a gas having a pressure of from 0.5 to 3 bar in a swirling nozzle, and immediately thereafter, shrinking with an overfeed of from 40 to 80% at from 220° to 240° C. for at least 0.2 sec to form a stretchable multifilament weft yarn. This weft yarn has a rough surface with non-slip properties, a tenacity of greater than 7 cN/tex, an elongation at break of from 170 to 270% and a thermal shrinkage at 160° C. of from +2% to −2%, measured at 160° C. during 15 minutes at a pretension of 0.1 cN/tex.

4 Claims, No Drawings

METHOD FOR CONTINUOUS PRODUCTION OF POLYESTER WEFT YARN FOR TIRE CORD FABRIC AND WEFT YARN MADE BY SAME

BACKGROUND OF THE INVENTION

The invention concerns a method for the continuous production of a multifilament stretchable weft yarn from polyester-POY-filaments for tire cord fabrics, as well as a weft yarn produced in accordance with the method.

A polyester-POY (partially oriented yarn) is understood to mean a yarn produced by the melt spinning of polyester at 2,800 to approximately 4,200 m/min.

Methods for the production of weft yarns for tire cord fabrics which have a rough non-slip surface and meet the high thermal and mechanical load requirements encountered in the manufacture of, are known. Apart from the methods for producing coated weft yarns, methods are also known for producing uncoated polyester weft yarns. In the known methods, the non-slip strength is either achieved by wrapping with natural fibres or by the twisting of a yarn of polyester-POY and subsequent heat treatment (EP-A-0 223 301). On air nozzle machines, a wrapped yarn leads to an unacceptable fibre flight. A twisted stretchable weft yarn is produced in at least two production steps that are technically labor intensive; an additional swirling would add a further step to the labor-intensive method. In the state of the art, the possibility of swirling effected in the winding up zone is admittedly mentioned, but a method of technical action is not indicated. The combination of swirling/twisting serves no purpose per se, since a worse method for obtaining a yarn finish is combined with a better method and hence the first step of the method becomes superfluous. A reversal of this step, that is to say, twisting/swirling is not expedient, since a twisted, and hence largely closed, yarn bundle can only be insufficiently swirled.

If the swirling is effected on its own, it is usually effected before the spooling, that is to say, after all other steps of the method have been completed. In the present case, that of swirling shrunk POY, this process leads to a non-homogeneous yarn with many projecting filament bends which impede proper unspooling.

SUMMARY OF THE INVENTION

It is the object of the invention to provide a technologically simple and economic method for producing a highly stretchable polyester weft yarn for tire cord fabrics.

A further object is to provide a weft yarn with a high elongation which also remains preserved after an extreme thermal loading. At the same time, the yarn is to show very low thermal shrinkage and as large a running length as possible per unit weight.

These objects are attained by a method for making a weft yarn according to the invention, in which the polyester-POY-filament with an initial titre of dtex 170–260 is swirled by means of a pressurized gas and is shrunk immediately thereafter with an overfeed of 40–80% at 230°–240° C.

The titre range of 170–260 dtex, in particular 170–210 dtex preferably 170–190 dtex, has proved particularly advantageous, since titres exceeding 260 dtex are unsuitable for reasons of weaving technology for tire cords and since with an elongation of 80% they require too high a force. The threads have to lie as flat as possible in the cord fabric, so that at the warp/weft crossing points there do not occur any undesirable raised portions which are unevenly coated in the dipping process. At a titre below 170 dtex, the tenacity is too low and the reversibility is inadequate. It has, moreover, proved to be expedient to effect a temperature treatment directly after the swirling, in which arrangement, an inadequate triggering of shrinkage occurs at temperatures below 230° C., and over 240° C., the polymer is already damaged. At the same time, an overfeed of 40–80%, in particular of 50–70% is expedient.

It has also proved expedient to effect the swirling in a swirling nozzle, in particular in a closed swirling nozzle at 0.5 to 3 bar, in particular at 1 to 2 bar. In an open swirling nozzle, a reliable swirling is not always ensured at low yarn tensions (only the running off tension) and at the applied pressure, since the filaments may be blown out of the nozzle. At a pressure below 0.5 bar, an inadequate yarn finish is obtained. At a pressure above 3 bar, the yarn finish is not improved, but there does already occur a partial damage of the filaments.

The thermal shrinkage is expediently effected performed 220°–235° C. in particular 230°–235° C. for a duration of at least 0.2 seconds, preferably in a convection heater. This has the advantage that a reversibility limit of more than 3 cN/tex is obtained, and that an adequate roughness or non-slip strength is ensured.

Experience has shown that highly stretchable weft yarns of shrunk polyester-POY tend towards elongation during a subsequent thermal treatment, such as those to which cord fabrics are subjected during impregnation. This elongation may give rise to uneven cord fabrics, which may cause difficulties during further processing. In such cases, it is expedient to redraw the weft yarn by 1 to 5% during manufacture in a further, in particular an integrated, step of the method immediately following the shrinkage, at a temperature of 100° to 200° C., in particular 110° to 170° C., and to spool it thereupon.

At the same time, the weft yarn in accordance with the invention meets the following conditions: the surface of the weft yarn is rough and has non-slip properties, the tenacity is greater than 7 cN/tex, the elongation 170–270% and the thermal shrinkage (at 160° C.) is in the range of +2% to −2% .

It is expedient if the burl count amounts to more than 25 burls/m. At less than 25 burls/m, the fibril bond is not sufficiently compact, because of which there may occur running off problems and dip deposits.

After a thermal treatment free of any yarn tension at 235° C., the fed yarn has an elongation of at break at least 110% and a yarn lengthening of less than 5%.

The invention will be described in greater detail with reference to some examples.

EXAMPLE 1

Starting with a dtex 170f72 polyester-POY melt spun at 3100 m/min, swirling is performed between a creel and a first delivery device at 2 bar in a closed swirling nozzle (2×1.2 mm) and immediately thereafter, shrinking is effected with an overfeed of 50% at 230° C. and subsequently, redrawing is performed at room temperature or 160° C.

In the following Table I the properties of a weft yarn made by the method of this example 1 of the invention after shrinkage are indicated without and with 5% redrawing. Examples 2–4 concern the manufacturing conditions in accordance with the invention without redrawing.

TABLE I

Weft Yarn Properties for Yarn of Example I after Shrinkage with and without Redrawing

| Property | no Redrawing | Redrawing 5% | Redrawing 5% at 160° C. |
|---|---|---|---|
| titre, dtex | 266 | 253 | 259 |
| tensile strength, cN | 181 | 183 | 189 |
| tenacity, cN/tex | 6.8 | 7.2 | 7.3 |
| elongation, % | 242.6 | 229 | 232.8 |
| thermal shrinkage, % at 160° C. | −1.7 | 0.35 | 1.8 |
| thermal shrinkage, % at 190° C. | −2.7 | 0.7 | 1.5 |

After a thermal test treatment of 235° C. for 2 minutes:

TABLE II

Weft Yarn Properties for Yarn of Example I after shrinkage with and without Redrawing, after Heat Treatment at of 235° C. for 2 minutes

| Property | no Redrawing | Redrawing 5% | Redrawing 5% at 160° C. |
|---|---|---|---|
| titre, dtex | 209 | 215 | 207 |
| tenacity, cN/tex | 7.9 | 8.5 | 8.0 |
| elongation, % | 156.5 | 157 | 149.7 |
| lengthg., % | −4.7 | −2.75 | −0.45 |

EXAMPLE 2

Polyester-POY feed yarn: 190 f 36 dtex

Swirling Pressure: 1 bar

| Overfeed % | 20 | 40 | 60 | 80 | 100 |
|---|---|---|---|---|---|
| titer, dtex | 239.10 | 280.80 | 321.60 | 359.90 | 399.40 |
| tensile, strength, cN | 270.66 | 273.22 | 296.52 | 321.03 | 343.88 |
| tenacity, cN/tex | 11.32 | 9.73 | 9.22 | 8.92 | 8.61 |
| elongation, % | 145.60 | 186.50 | 231.00 | 261.20 | 292.30 |
| TS 160, % | 0.20 | −1.20 | −1.80 | −1.60 | 0.00 |
| TS 190 ,% | −0.70 | −2.70 | −3.40 | −3.60 | −1.30 |
| increase in titre, % | 20.30 | 41.25 | 61.8 | 81.03 | 101.90 |
| reverse limit, cN/tex | 5.1 | 4.4 | 4.0 | 3.7 | 3.72 |
| After 2 min at 240° C. | | | | | |
| titer, dtex | 239.10 | 280.80 | — | 359.90 | 399.40 |
| tensile strength, cN | 267.55 | 273.22 | — | 309.87 | 330.30 |
| residual tensile strength, % | 98.85 | 100.00 | — | 96.52 | 96.05 |
| tenacity, cN/tex | 11.19 | 9.73 | — | 8.61 | 8.27 |
| elongation, % | 108.90 | 128.50 | — | 169.20 | 197.40 |
| change in length, % | −0.20 | −3.80 | — | −4.80 | −3.20 |
| reverse limit, cN/tex | 1.24 | 1.35 | — | 1.55 | 1.63 |

wherein TS = thermal shrinkage

EXAMPLE 3

Polyester-POY feed yarn: 190 f 36 dtex

Swirling Pressure: 2 bar

| Overfeed, %: | 20 | 40 | 60 | 80 | 100 |
|---|---|---|---|---|---|
| titre, dtex | 243.90 | 278.60 | 317.90 | 358.90 | 399.80 |
| tensile strength, cN | 215.61 | 239.87 | 293.10 | 321.93 | 343.43 |
| tenacity, cN/tex | 8.84 | 8.61 | 9.22 | 8.97 | 8.59 |
| elongation, % | 124.40 | 172.30 | 225.50 | 259.70 | 288.50 |
| TS 160, % | 0.30 | −1.10 | −1.50 | −0.20 | 1.40 |
| TS 190, % | −0.50 | −2.70 | −3.50 | −2.50 | −1.00 |
| titer increase, % | 22.70 | 40.14 | 59.90 | 80.50 | 101.10 |
| reverse limit, cN/tex | 4.8 | 4.4 | 3.9 | 3.6 | 3.4 |
| After 2 min at 240° C.: | | | | | |
| titer, dtex | — | 278.60 | 317.90 | 358.90 | 399.80 |
| tensile strength, cN | — | 261.88 | 290.56 | 322.65 | 351.42 |
| residual tensile strength, % | — | 109.18 | 99.13 | 100.22 | 102.33 |
| tenacity, cN/tex | — | 9.40 | 9.14 | 8.99 | 8.79 |
| elongation, % | — | 116.50 | 147.20 | 179.40 | 215.40 |
| change in length, % | — | −3.40 | −4.70 | −3.20 | 0.20 |
| reverse limit, cN/tex | — | 1.35 | 1.51 | 1.61 | 1.69 |

wherein TS = thermal shrinkage

EXAMPLE 4

Polyester-POY feed yarn: 260 f 48 dtex swirling Pressure: 2 bar

| Overfeed, %: | 20 | 40 | 60 | 80 | 100 |
|---|---|---|---|---|---|
| titer, dtex | 333.70 | 377.30 | 426.80 | 478.30 | 532.90 |
| tensile strength, cN | 305.34 | 345.23 | 384.55 | 431.90 | 461.49 |
| tenacity, cN/tex | 9.15 | 9.15 | 9.01 | 9.03 | 8.66 |
| elongation, % | 112.70 | 155.50 | 200.20 | 238.90 | 274.30 |
| TS 160, % | −1.50 | −3.20 | −4.00 | −3.20 | −2.20 |
| TS 190, % | −3.00 | −5.60 | −5.70 | −5.50 | −3.60 |
| increase in titre, % | 27.40 | 44.00 | 62.90 | 82.60 | |
| 103.30 | 4.6 | 4.2 | 3.8 | 3.5 | |
| reverse limit, cN/tex | | | | | |
| 3.1 | | | | | |

wherein TS = thermal shrinkage

Apart from the single-stage feature of the method wherein the swirling, shrinkage and redrawing are continuously performed in one step of the method, the weft yarn in accordance with the invention shows, in particular, a pronounced reduction of the lengthening tendency after the additional heat treatment at 235° C., whereby it only then achieves its preeminent suitability as a weft yarn in the manufacture of tires. It is surprising that the roughness or the non-slip properties can be achieved without twisting or coating. After the occurrence of the twisting, the disadvantageous elongation can be substantially reduced by an additional hot drawing.

We claim:

1. A method for continuous production of a stretchable multifilament weft yarn for tire cord fabric from polyester-POY-filaments, said method comprising the steps of:

a) swirling polyester-POY-filaments with an initial titre of from 170 to 260 dtex by means of a gas having a pressure of from 0.5 to 3 bar in a swirling nozzle, and b) immediately after the swirling of step a), shrinking with an overfeed of from 40 to 80% at from 220° to 240° C. for at least 0.2 sec to form the stretchable multifilament weft yarn.

2. The method according to claim 1, further comprising continuously redrawing the weft yarn from 1 to 5% at 100° to 220° C.

3. A polyester weft yarn for tire cord fabric made by a method comprising swirling polyester-POY-filaments with an initial titre of from 170 to 260 dtex by means of a gas having a pressure of from 0.5 to 3 bar in a swirling nozzle, and, immediately thereafter, shrinking with an overfeed of from 40 to 80% at 220° to 240° C. for at least 0.2 sec, wherein the weft yarn has a rough surface and non-slip properties, a tenacity of greater than 7 cN/tex, an elongation at break of from 170 to 270% and a thermal shrinkage at 160° C. of from +2% to −2%, measured at 160° C. during 15 minutes at a pre tension of 0.1 cN/ tex.

4. The weft yarn according to claim 3, having an elongation at break of at least 110% and a yarn lengthening of less than 5%, after a heat treatment, free of any thread tensile force, at 235° C.

* * * * *